US005976025A

United States Patent [19]

Williams

[11] Patent Number: 5,976,025

[45] Date of Patent: Nov. 2, 1999

[54] GOLF PUTTER HAVING THREE BALL-STRIKING SURFACES

[76] Inventor: Bernard R. Williams, 18600 Northville Rd., Suite 100, Northville, Mich. 48167

[21] Appl. No.: 09/021,979

[22] Filed: Feb. 11, 1998

Related U.S. Application Data

[60] Provisional application No. 60/037,512, Feb. 11, 1997.

[51] Int. Cl.[6] ..... A63B 53/04

[52] U.S. Cl. ..... 473/252; 473/293; 473/313; 473/325; 473/340; 473/294

[58] Field of Search ..... 473/313, 294, 473/293, 243, 325, 251, 252, 253, 254, 255, 256, 340, 341

[56] References Cited

U.S. PATENT DOCUMENTS

| | | |
|---|---|---|
| 2,708,579 | 5/1955 | Hugman . |
| 3,042,405 | 7/1962 | Solheim . |
| 3,679,207 | 7/1972 | Florian . |
| 4,010,958 | 3/1977 | Long . |
| 4,962,931 | 10/1990 | Jazdsyk, Jr. . |
| 5,176,379 | 1/1993 | Reinberg . |
| 5,333,873 | 8/1994 | Burke . |
| 5,415,399 | 5/1995 | Kettelson . |

*Primary Examiner*—Sebastiano Passaniti
*Attorney, Agent, or Firm*—Charles W. Chandler

[57] ABSTRACT

A golf putter includes a putter head that is equipped with three ball-striking surfaces, such that the putter can be used by a right-handed golfer or a left-handed golfer, employing either a conventional putting stance perpendicular to the ball roll path or a non-conventional putting stance facing the ball target. The club head is connected to the shaft at a center location coinciding with the head center of gravity. Also, the upper surface of the putter has a central cavity and two opposing rails that cause the putter weight to be concentrated at the perimeter of the head, thus tending to minimize the effect of mishits on ball travel accuracy on all three ball striking positions. The shaft to head connection is aligned with the ball roll in all ball striking positions.

15 Claims, 6 Drawing Sheets

GOLF PUTTER HAVING THREE BALL-STRIKING SURFACES

CROSS REFERENCE TO A RELATED PATENT APPLICATION

This patent application is a continuation of a co-pending provisional patent application Ser. No. 60/037,512 that I filed on Feb. 11, 1997, entitled PUTTER BODY.

BACKGROUND OF THE INVENTION

1. Field of the Invention

This invention relates to a golf putter, and particularly to a long shafted golf putter having a putter head that has three individual ball-striking surfaces. The putter head has a ball-striking surface on the toe, a second ball-striking surface at the front of the putter body, and a third ball-striking surface at the rear of the putter body. The putter is thereby suited for use by either right or left-handed golfers facing either perpendicular to the ball roll path or parallel to the ball roll path.

2. Prior Art Developments

Conventional long shafted putters are designed for use by both right-handed golfers and left-handed golfers, but usually not by using the toe of the putter by both right and left handed golfers.

A conventional long shafted golf putter usually has a shaft that has a length of about fifty inches. The golfer places his hands at spaced points along the putter shaft, with his body perpendicular to the ball roll path. The putter is held in front of the golfer's body and swung in a vertical arc toward the target. The golfer uses a swinging motion. As far as I am aware no putter uses the toe area.

SUMMARY OF THE INVENTION

The present invention relates to a golf putter that can be used by either right-handed golfers or left-handed golfers, employing either a stance facing the target or a stance facing perpendicular to the ball roll path. The putter of the present invention has a greater versatility and range of usefulness not possessed by conventional prior art putters.

A preferred long shafted golf putter head has a first front ball-striking surface, a second rear ball-striking surface, and a third ball-striking surface on the toe area of the putter head.

The front ball-striking surface is used by a right-handed golfer, using the conventional stance facing perpendicular to the intended roll path of the golf ball. The rear ball-striking surface is used by a left-handed golfer, using the conventional stance. The toe ball-striking surface is used by either a right-handed golfer or a left-handed golfer, employing a stance facing the target.

The putter of this invention enables a golfer to experiment with different stances, using a right-handed stroke or a left-handed stroke. With the benefit of such experimentation, the golfer can adopt the stance and stroke that is most comfortable and productive.

Further features of the invention will be apparent from the attached drawings and description of a preferred embodiment of the invention.

DESCRIPTION OF A PREFERRED EMBODIMENT OF THE INVENTION

Figure 5:
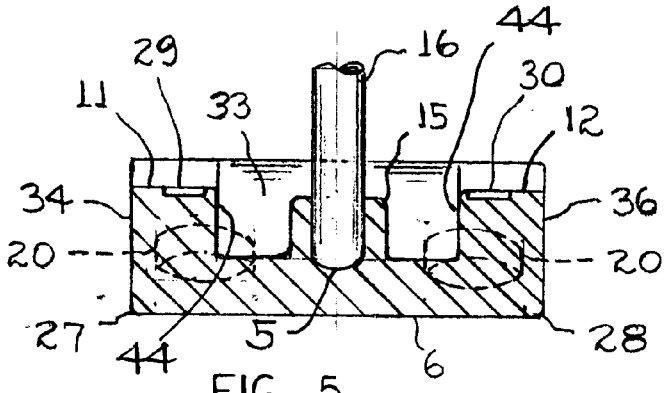
FIG. 5 is a sectional view taken on line 5–5 in FIG. 1.

FIGS. 1 through 6 show a golf putter embodying features of the invention. The putter comprises a putter head 4 and a shaft 16 connected to the head by means of a central socket 15 integral with the putter head. As shown in FIG. 5, socket 15 comprises an upstanding annular wall fitting the lower end of shaft 16.

Putter head 4 can be machined or cast out of aluminum, titanium or other suitable material. As viewed in the top plan view (FIG. 1), the putter head has a rectangular shape that provides a flat front ball-striking surface 36, a flat rear ball-striking surface 34, a flat toe ball-striking surface 13, and a heel surface 14. Shaft 16 has a longitudinal axis that connects to the putter head at a connection point 5 defined by socket 15.

Connection point 5 is located midway between front ball-striking surface 36 and rear ball-striking surface 34. Also, connection point 5 is located approximately midway between toe surface 13 and heel surface 14. The putter head is designed so that connection point 5 coincides with the center of gravity of the putter head. Shaft 16 is located in a vertical plane that parallels the planes of ball-striking surfaces 34 and 36, when the putter is oriented in the position depicted in FIGS. 1 and 2.

Figure 2:
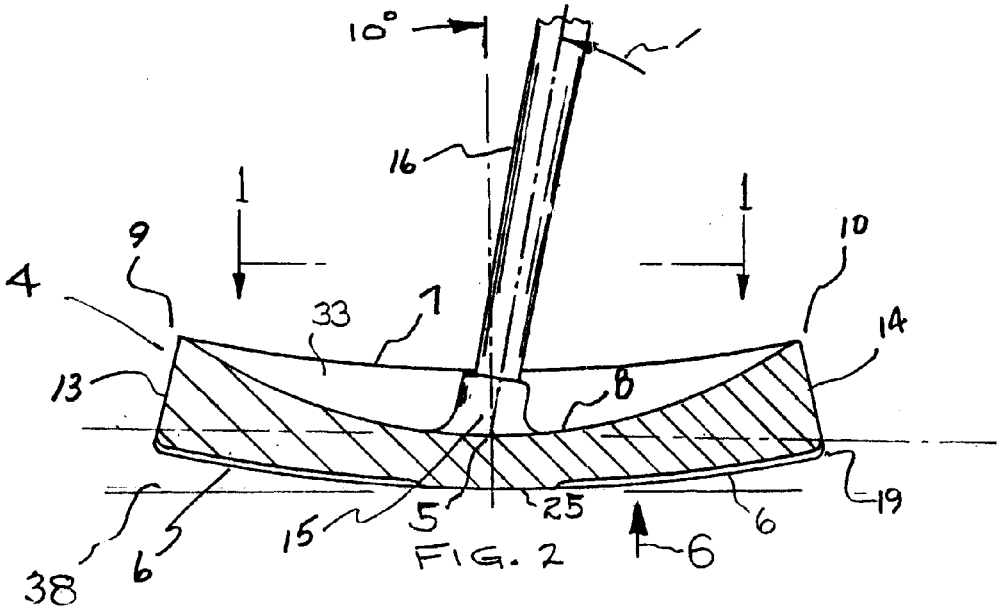
FIG. 2 is a sectional view taken on line 2—2 in FIG. 1.
Figure 3:
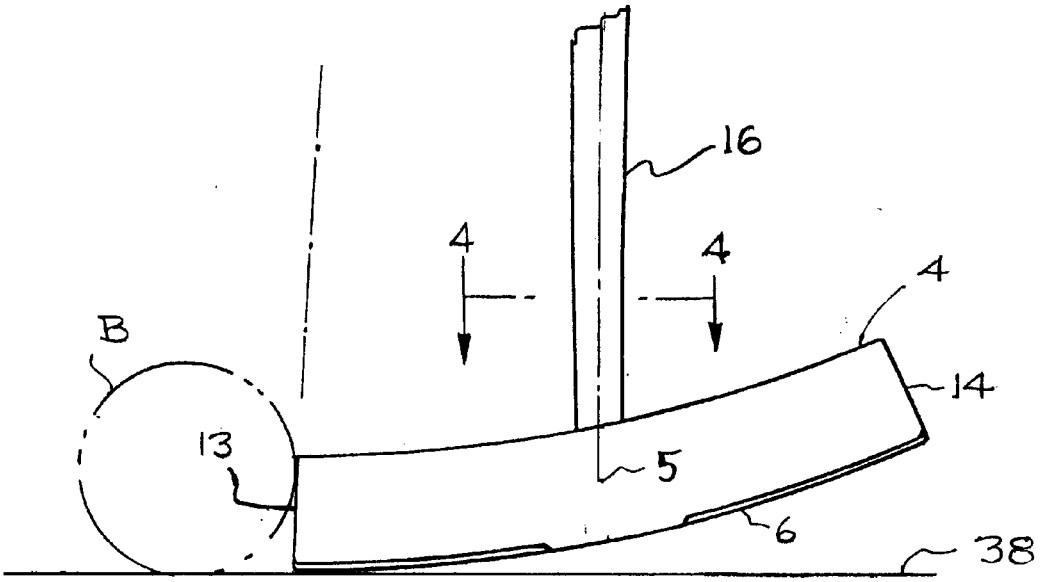
FIG. 3 is a fragmentary side elevational view of the FIG. 1 golf putter, shown in position with toe surface 13 in contract with a golf ball.
Figure 4:
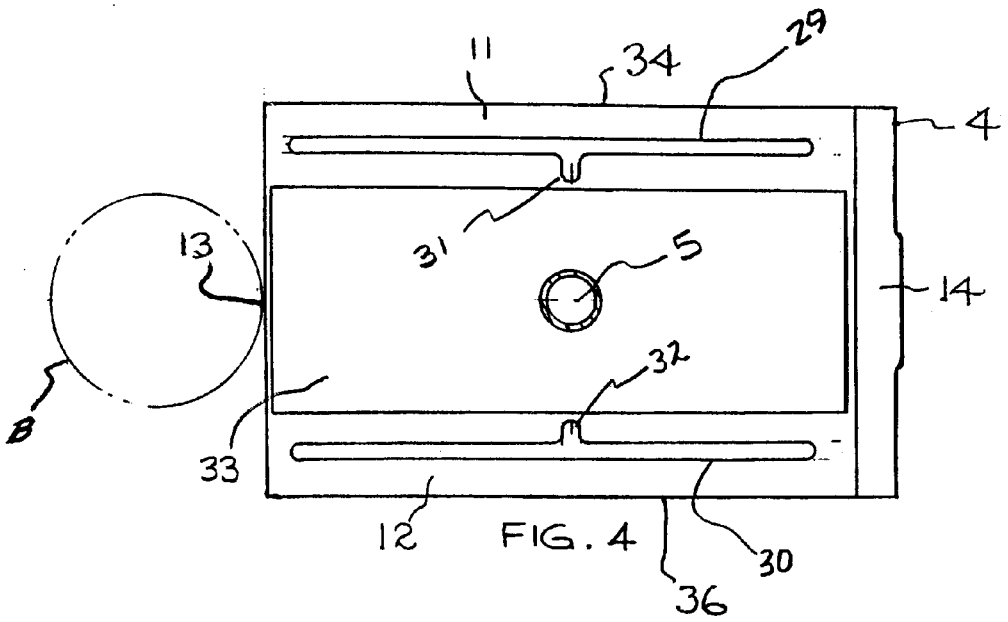
FIG. 4 is a top plan view of the FIG. 3 golf putter head, looking in the direction of line 4—4 in FIG. 3.

As shown in FIG. 2, the putter head has a bottom (sole) surface 6 that has a convex arcuate configuration in a profile plane parallel to ball-striking surfaces 34 and 36. With such a sole surface configuration, the lower edge 19 of heel surface 14 is spaced above the ground surface 38 when the putter head is swung in a normal arc during a conventional putting stroke.

FIG. 2 shows shaft 16 at an acute angle 40 to an imaginary vertical line extending through shaft-head connection point 5. Angle 40 typically measures about ten degrees or more. FIG. 2 shows the golf club in an attitude that occurs during the conventional putting stroke (i.e. with the golfer facing perpendicular to the roll path of the golf ball). Lower edge 19 of the heel surfaces 14 is spaced above the ground surface, such that the striking surface 36 (or 34) tends to strike the golf ball B (FIG. 1) along a line aligned with connection point 5 and in a motion aligned with the intended roll path. This feature concentrates the striking force along the center of gravity of the putter head, and thus tends to prevent mishits.

As shown in FIGS. 1 and 7 through 14, the golf putter can be used in various ways. Depending on the stance used by the golfer, the golf ball B can be struck by flat front surface 36, or by rear surface 34, or by flat toe surface 13. Heel surface 14 is not a ball-striking surface, and it is not required to be flat or specially configured.

As shown in FIGS. 7 through 14, shaft 16 is gripped at two spaced points along the shaft. The shaft is about fifty three inches long, to permit the shaft to be gripped as shown in FIGS. 7 through 14.

Figure 13:
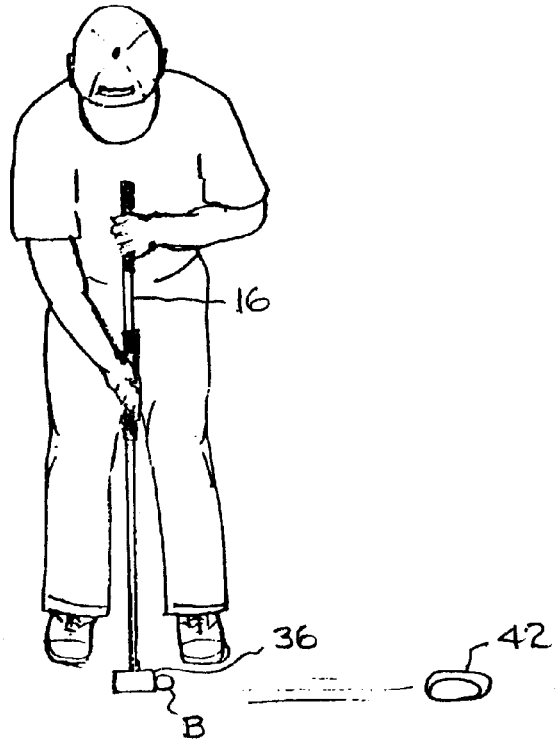
FIG. 13 shows the FIG. 1 golf putter while used by a right-handed golfer in a conventional stance facing perpendicular to the ball roll path.

FIG. 13 shows the putter used by a right-handed golfer, employing the conventional stance facing perpendicular to the ball roll path. Front surface 36 is used as the ball-striking surface.

Figure 14:
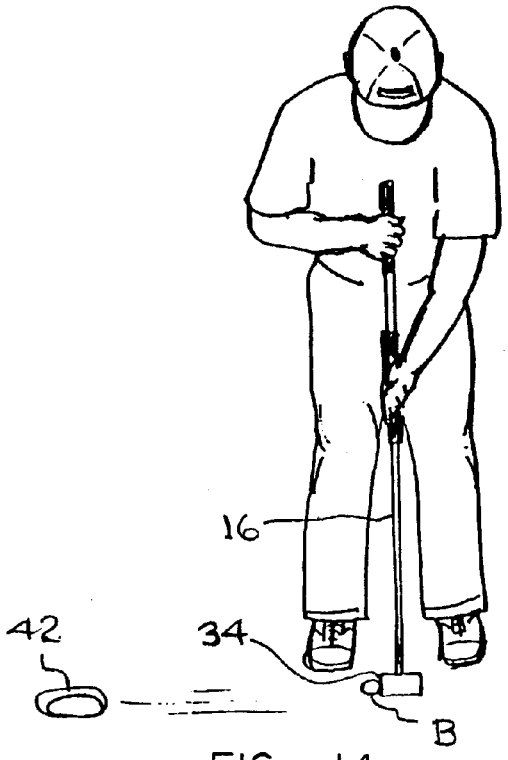
FIG. 14 shows the FIG. 1 golf putter, while used by a left-handed golfer in the conventional stance facing perpendicular to the intended path of the golf ball.

FIG. 14 shows the putter used by a left-handed golfer, employing the conventional stance facing perpendicular to the ball roll path. Rear surface 34 is used as the ball-striking surface.

Figure 7:
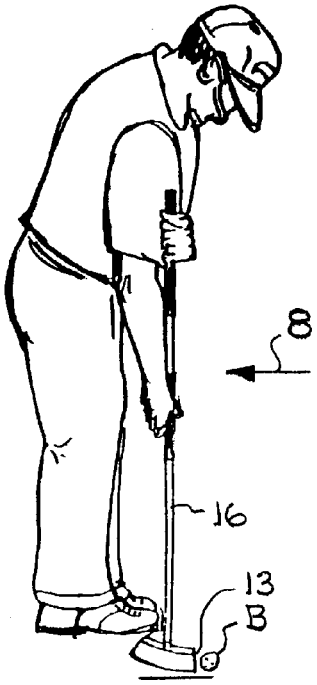
FIG. 7 shows a right-handed golfer using the FIG. 1 golf putter in a stance facing the target (usually the golf hole).
Figure 8:
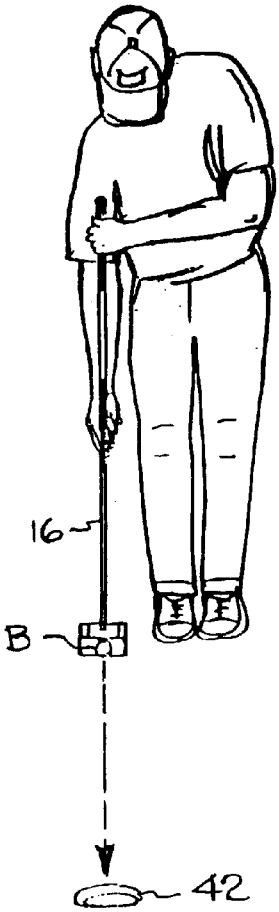
FIG. 8 is a side elevational view taken in the direction of arrow 8 in FIG. 7.
Figure 9:
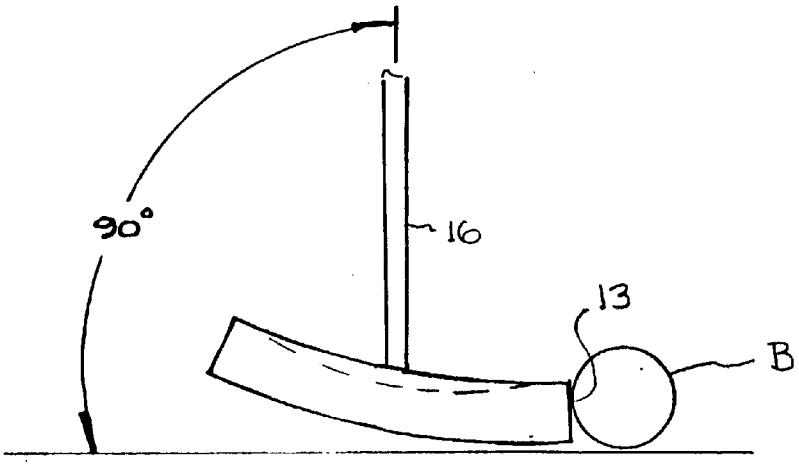
FIG. 9 is an enlarged fragmentary view of the golf putter, as used by the golfer in the stance illustrated in FIG. 7.

FIGS. 7 through 9 show the putter, as used by a golfer in a non-conventional stance facing the target, i.e. golf hole 42. The putter is held at the golfer's right side and swung in an arc alongside his body. Toe surface 13 is used as the ball-striking surface. FIG. 9 shows the putter-ball relationship at the instant of ball contact.

Figure 10:
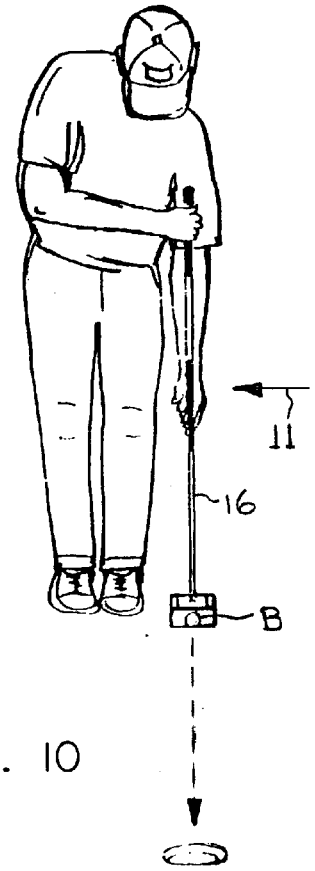
FIG. 10 shows a left-handed golfer using the FIG. 1 golf putter in a stance facing the intended target.
Figure 11:
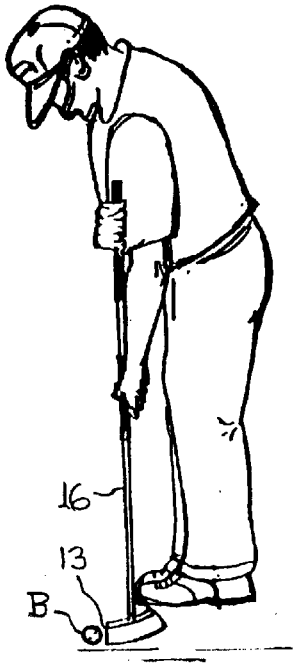
FIG. 11 is an elevational view taken in the direction of arrow 11 in FIG. 10.
Figure 12:
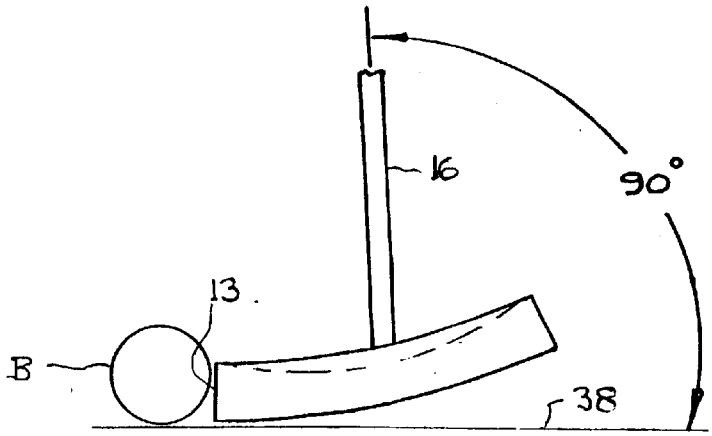
FIG. 12 is an enlarged fragmentary view of the golf putter, as used by the golfer depicted in FIG. 11.

FIGS. 10 through 12 show the putter used in the same fashion as shown in FIGS. 7 through 9, except that the golf club is held at the golfer's left side. Again, toe surface 13 is used as the ball-striking surface.

The putter of this invention provides a single multi-purpose club for putting the ball. This putter can be used for all types of right and left-handed golfers, that have acquired various types of stances, ball positions and putting strokes. This club has two side striking faces 34 and 36, as well as an extra toe striking face, used for a frontal stance in which the shaft is aligned with the intended roll path (as shown in FIGS. 8 and 10).

This frontal position has the golfer standing with feet, chest, eyes and arms facing the hole. For right-hand golfers (left-hand opposite) the ball position is along side his right foot, below his right arm far enough away from his right leg to freely swing his right arm along side his body towards the hole, similar to throwing a baseball underhand at the pitchers mound. With the toe face of the club and the shaft of the club behind the ball and the shaft extending from the ground upwards along the players right arm, the right hand holds the club below the golfers waist. Since the golfer is facing the hole, the left arm bends at the elbow, crosses in front of the torso and the left hand holds the top of the putter shaft, close to the right arm, close enough to create an effect of the arm and shaft swinging as an integral unit. With the club securely held with both hands, the golfer can swing his right arm back and forth (similar to throwing a ball underhanded) striking the ball with the toe face of the putter towards the hole.

The toe face 13 and the two putter body side faces 34 and 36, achieve a versatile putter with three ball striking faces for right and left handed golfers to be used with unlimited ball positions and stances, making putting the most creative and exciting element of the game of golf.

Figure 1:
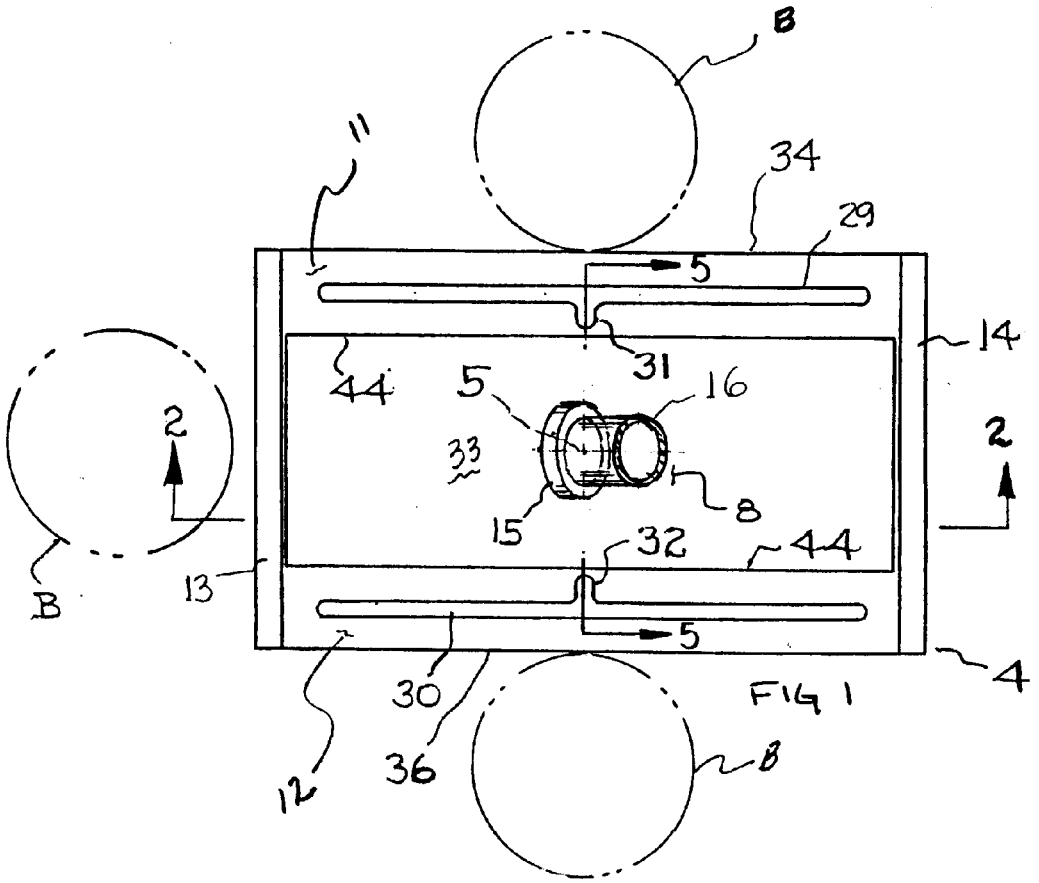
FIG. 1 is a top plan view of a putter head used on a golf putter embodying the invention. The golf putter shaft is shown in section, taken on line 1—1 in FIG. 2.

Referring particularly to FIGS. 1, 2 and 5 of the drawings, putter head 4 is shown as having a central cavity 33 extending from a point near toe surface 13 to a point near heel surface 14. Cavity 33 is defined by a concave arcuate bottom surface 8 having a lesser radius of curvature than convex arcuate sole surface 6. This difference in radius curvature causes the putter head vertical thickness to be relatively greater at points near the toe and heel surfaces 13 and 14, and relatively smaller at central shaft-head connection point 5. This feature causes the putter head to be perimeter weighted, i.e. to have a greater portion of the weight located near the perimeter surfaces 13 and 14.

Cavity 33 has two vertical side surfaces 44 (FIG. 5) spaced from ball-striking surfaces 34 and 36, to form two upstanding rails 11 and 12 proximate to striking surfaces 34 and 36. Cavity side surfaces 44 are parallel to surfaces 34 and 36 so that rails 11 and 12 act to distribute the putter head weight uniformly away from the central connection point 5. The putter head is thus perimeter-weighted and faced balanced, such that off center hits have a lessened effect on ball trajectory.

Perimeter-weighting is also enhanced by four cylindrical plug weights 20 embedded in the putter head near the four corners formed by intersecting surfaces 13, 34, 14, and 36. Each weight is formed of a material suited for the putter head. As will be seen from FIGS. 5 and 6, the weights are inserted into openings formed in sole surface 6 of the putter head. The individual weights can be cast in place, or alternatively have screw connections with the associated openings in the putter head.

As a further feature of the invention, line-of-sight markings 29 and 30 are located on the upper edge of each rail 11 or 12 so as to be visible to a golfer in a putting stance. Preferably these line-of-sight markings are narrow line-like indentations in the rail edge surface. Each line-of-sight marking includes a long narrow indentation running parallel to ball-striking surfaces 34 and 36; these indentations are used for sighting purposes when the golfer is facing the ball roll path, as in FIGS. 8 and 10. Each line-of-sight marking further includes a short arrow-type marking 31 or 32. Markings 31 and 32 are aligned on an imaginary plane perpendicular to surfaces 34 and 36 and running through central connection point 5, as shown in FIG. 1. Arrow-type markings 31 and 32 are used when the golfer uses the conventional putting stance, as shown in FIG. 13 or 14.

Figure 6:
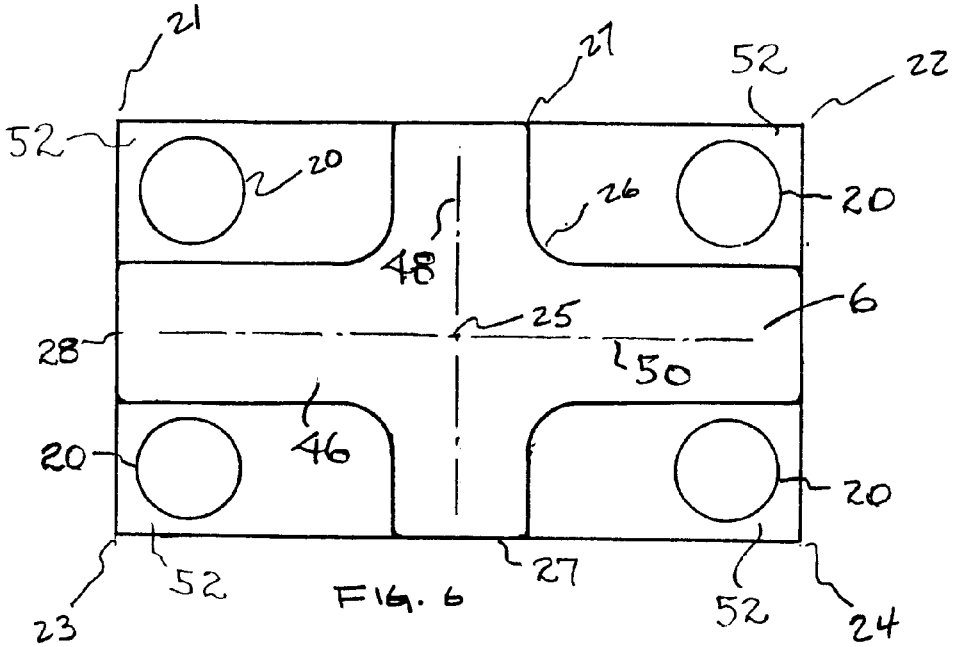
FIG. 6 is a bottom plan view of the FIG. 1 golf putter head, taken in the direction of arrow 6 in FIG. 2.

An additional feature of the invention is depicted in FIGS. 2 and 6. A cross-shaped central area of sole surface is embossed, as at 46, to reduce drag between the sole surface and ground surface 38 during the putting stroke. The non-embossed corer areas of sole surface 6 are elevated slightly from embossed areas 46 so as to normally never come into contact with the ground surface.

As shown in FIG. 6, sole surface 6 is embossed in areas thereof extending along the front-to-rear axis 48 of the putter head and also in areas extending along the toe-to-heel axis 50. Corner areas 52 are recessed so as to normally be out of contact with the ground surface. The transition areas 27 and 28 between the embossed surface and the club faces may be rounded to further reduce drag.

By way of summarization, the invention provides a substantial rectangular shaped putter body, perimeter weighted and face balanced, with three individual ball striking surfaces. The putter body has one ball striking face on the toe of the putter body, along with two parallel ball striking faces on the front and rear sides of the rectangular shaped putter body. This gives the player three different ball striking faces in one putter head.

A further feature of the invention is a generally longer putter shaft 16 of the club, to be positioned in the connection point 5 of the putter body, so that the shaft center line is always directly behind the ball and the intended line to the hole. The shaft putter head connection point 5 is aligned with the ball roll path when hitting the ball with the toe striking face, as well as with either of the side striking faces.

When viewing the putter from the side ball striking positions, bottom sole surface 6 is generally rounded. The sole and generally matching top surface 7 of the putter body are formed by two different radii, struck from the same tangent point, providing a similar uniform cross section thickness from toe to heel. Also, from the side view, an inner cavity area 33 is formed by a third smaller radius 8 with its intersecting arc ending at the top surface of the toe and heel on the putter body.

When viewed in plan, the inner cavity area 33 of the putter body forms two parallel rails 11, 12 along the two ball striking faces 34 and 36. When end viewing the putter, toe 13 and heel faces 14 are solid, and the center of the cavity 33 area is vacant.

Additionally when the sole 6 of the club is in its normal address position for the two parallel ball striking faces 34 and 36, the toe and heel are equally spaced away from level ground. The projection of the straight part of the shaft 16 onto the vertical plane through the toe and heel diverges from vertical generally by a minimum of ten degrees, towards the golfer, to comply with the rules of the U.S.G.A and P.G.A. Socket 15 for shaft 16 is located in the center of cavity 33.

The putter body and shaft are so structured that when the putter is tilted up on its front edge, the toe 13 striking face is square to the ball. This tilt is achieved by rotating the axis of the putter shaft forward from its parallel ball striking faces, until it is perpendicular to level ground. Additionally, heel 19 of the club is completely cleared away from the ground, in the toe striking position, eliminating any contact or drag with the ground when stroking the putter back and forth in a conventional putting stroke.

The invention provides a perimeter-weighted putter body balanced for off center hits in all three ball striking positions, i.e. balance for the ball striking face on the toe of the body, along with balance for off center hits on two parallel ball striking faces 34 and 36 on the body.

Having described my invention, I claim:

1. A golf putter comprising a putter head having an upper surface and a lower sole surface; and a shaft extending upwardly from said putter head; said putter head having a front ball-striking surface, a rear ball-striking surface, a toe ball-striking surface, and a heel surface, said shaft having a shaft-putter head connection that is located midway between said front surface and said rear surface; said shaft-putter head connection being located approximately midway between said toe ball-striking surface and said heel surface; said shaft having a longitudinal axis that lies in a plane that generally parallels the planes of said front and rear ball-striking surfaces; said shaft longitudinal axis extending at an acute angle to a plane containing the sole surface of the putter head at said shaft-putter head connection;

said putter head having a cavity in its upper surface; said cavity having two side surfaces extending parallel to said front and rear ball-striking surfaces, whereby said cavity forms two upstanding rails proximate to said front and rear ball-striking surfaces; said cavity having a bottom surface spaced a relatively great distance from said lower sole surface at the toe and heel areas of said putter; said cavity bottom surface being spaced a relatively small distance from said lower sole surface at said shaft-putter head connection, whereby said putter head is perimeter weighted.

2. The golf putter of claim 1, wherein said acute angle is approximately ten degrees or more.

3. The golf putter of claim 1, wherein said shaft-putter head connection comprises a socket integral with said putter head.

4. The golf putter of claim 3, wherein said socket comprises an annular wall upstanding upwardly within said cavity.

5. The golf putter of claim 3, wherein each said rail has an upwardly-facing edge surface; and a ball-direction arrow recessed into the upwardly-facing edge surface of each rail; said ball-direction arrows being aligned on an imaginary plane extending through said shaft-putter head connection generally perpendicular to said front and rear ball-striking surfaces.

6. The golf putter of claim 3, in which each rail has an upwardly facing edge surface, and a line of sight markings in said upward facing edge surfaces parallel to said front and rear ball-striking surfaces.

7. The golf putter of claim 1, wherein the lower sole surface of said putter head has a convex arcuate configuration, whereby the lower edge of said heel surface is spaced above the ground surface when the toe ball-striking surface is in normal ball-striking contact with a golf ball.

8. The golf putter of claim 1, wherein the lower sole surface of said putter head has a convex arcuate configuration in a profile plan parallel to said front and rear ball-striking surfaces, whereby the lower edge of said heel surface is spaced above the ground surface when the toe ball-striking surface is in normal ball-striking contact with a golf ball.

9. The golf putter of claim 8, wherein said putter head has a first front-to-rear axis and a second toe-to-heel axis; the lower sole surface of said putter head being recessed in areas thereof remote from said first and second axes.

10. The golf putter of claim 8, wherein said putter head has a first front-to-rear axis and a second toe-to-heel axis; the lower sole surface of said putter head being embossed in areas thereof extending along said first and second axes; the lower sole surface being recessed in areas thereof remote from said first and second axes.

11. The golf putter of claim 1, wherein said front ball-striking surface intersects with said toe surface and said heel surface to form two front corner areas; said rear ball-striking surface intersecting said toe surface and said heel surface to form two rear corner areas; and a weight embedded in each corner area of said putter head.

12. The golf putter of claim 11, wherein each weight has a cylindrical plug configuration.

13. The golf putter of claim 11, wherein each weight is embedded in said putter head.

14. The golf putter of claim 1, in which the head connection is aligned with an intended ball roll path whether the putter head is swung using either the front ball-striking surface, the rear ball striking surface or the toe ball-striking surface.

15. A golf putter comprising a putter head having an upper surface and a lower sole surface; and a shaft extending upwardly from said putter head; said putter head having a front ball-striking surface, a rear ball-striking surface, a toe ball-striking surface, and a heel surface, said shaft having a shaft-putter head connection that is located midway between said front surface and said rear surface; said shaft-putter head connection being located approximately midway between said toe ball-striking surface and said heel surface; said shaft having a longitudinal axis that lies in a plane that generally parallels the planes of said front and rear ball-striking surfaces; each of said ball-striking surfaces having a horizontal width that is wider than the diameter of a golf ball, and which lies in a plane that is either parallel to or inclined toward the handle of the shaft.

* * * * *